US005834640A

United States Patent [19]

Shivanath et al.

[11] Patent Number: 5,834,640

[45] **Date of Patent: *Nov. 10, 1998**

[54] POWDER METAL ALLOY PROCESS

[75] Inventors: Rohith Shivanath; Peter Jones, both of Toronto, Canada

[73] Assignee: Stackpole Limited, Mississauga, Canada

[ * ] Notice: The term of this patent shall not extend beyond the expiration date of Pat. No. 5,476,632.

[21] Appl. No.: 513,512

[22] Filed: Aug. 10, 1995

Related U.S. Application Data

[62] Division of Ser. No. 107,846, Jan. 14, 1994, Pat. No. 5,476,632.

[51] Int. Cl.[6] ..... C22C 33/02; C22C 38/00

[52] U.S. Cl. ..... 75/243; 75/245; 75/288; 75/252; 428/546

[58] Field of Search ..... 75/288, 245, 243, 75/252; 428/546

[56] References Cited

U.S. PATENT DOCUMENTS

| | | | |
|---|---|---|---|
| 4,233,073 | 11/1980 | Takemura | 75/243 |
| 4,393,563 | 7/1983 | Smith | 29/149.5 |
| 4,422,875 | 12/1983 | Nakata et al. | 75/245 |
| 5,082,433 | 1/1992 | Keithner | 419/11 |
| 5,512,236 | 4/1996 | Jones et al. | 419/28 |
| 5,516,483 | 5/1996 | Shivanath et al. | 419/14 |
| 5,540,883 | 7/1996 | Jones et al. | 419/28 |

FOREIGN PATENT DOCUMENTS

| | | |
|---|---|---|
| 1340775 | 1/1963 | France . |

*Primary Examiner*—Daniel J. Jenkins
*Attorney, Agent, or Firm*—Eugene J.A. Gierczak

[57] ABSTRACT

This invention relates to a method or process of forming a sintered article of powder metal, and particularly relates to a process of forming a sintered article of powder metal by blending combinations of finely ground ferro alloys (either singly or in combination with other ferro alloys) with elemental iron powder and other additives and then high temperature sintering of the article in a reducing atmosphere to produce sintered parts with oxygen contents less than 250 parts per million (ppm). More particularly the ferro alloys admixed to the base iron have a mean particle size of approximately 8 to 12 microns, having previously been ground to size in an inert atmosphere.

28 Claims, 4 Drawing Sheets

POWDER METAL ALLOY PROCESS

This is a division of U.S. application Ser. No. 08/107,846, filed Jan. 14, 1994, now U.S. Pat. No. 5,476,632.

FIELD OF INVENTION

This invention relates to a method or process of forming a sintered article of powder metal, and particularly relates to a process of forming a sintered article of powder metal by blending combinations of finely ground ferro alloys (either singly or in combination with other ferro alloys) with elemental iron powder and other additives and then high temperature sintering of the article in a reducing atmosphere to produce sintered parts with oxygen contents less than 250 parts per million (ppm). More particularly the ferro alloys admixed to the base iron have a mean particle size of approximately 8 to 12 microns, having previously been ground to size in a inert atmosphere.

BACKGROUND TO THE INVENTION

Powder metal technology is well known to the persons skilled in the art and generally comprises the formation of metal powders which are compacted and then subjected to an elevated temperature so as to produce a sintered product.

Conventional sintering occurs at a maximum temperature of approximately up to 1,150° C. Historically the upper temperature has been limited to this temperature by sintering equipment availability. Therefore copper and nickel have traditionally been used as alloying additions when sintering has been conducted at conventional temperatures of up to 1,150° C., as their oxides are easily reduced at these temperatures in a generated atmosphere, of relatively high dew point containing CO, $CO_2$ and $H_2$. The use of copper and nickel as an alloying material is expensive.

Moreover, copper when utilized in combination with carbon as an alloying material and sintered at high temperatures causes dimensional instability and accordingly the use of same in a high temperature sintering process results in a more difficult process to control the dimensional characteristics of the desired product.

Manufacturers of metal powders utilized in powder metal technology produce prealloyed iron powders which are generally more difficult to compact into complex shapes, particularly at higher densities (>7.0 g/cc). Manganese and chromium can be incorporated into prealloyed powders provided special manufacturing precautions are taken to minimize the oxygen content, for example, by oil atomization. Notwithstanding this, these powders still have poor compressibilities compared to admixed powders.

Conventional means to increase the strength of powder metal articles use up to 8% nickel, 4% copper and 1.5% molybdenum, in prealloyed, partially prealloyed, or admixed powders. Furthermore double press double sintering can be used for high performance parts as a means of increasing part density. Conventional elements are expensive and relatively ineffective for generating mechanical properties equivalent to wrought steel products, which commonly use the more effective strengthening alloying elements manganese and chromium.

Moreover, conventional technology as disclosed in U.S. Pat. No. 2,402,120 teach pulverizing material such as mill scale to a very fine sized powder, and thereafter reducing the mill scale powder to iron powder without melting it.

Furthermore, U.S. Pat. No. 2,289,569 relates generally to powder metallurgy and more particularly to a low melting point alloy powder and to the usage of the low melting point alloy powders in the formation of sintered articles.

Yet another process is disclosed in U.S. Pat. No. 2,027,763 which relates to a process of making sintered hard metal and consists essentially of steps connected with the process in the production of hard metal. In particular, U.S. Pat. No. 2,027,763 relates to a process of making sintered hard metal which comprises producing a spray of dry, finely powdered mixture of fusible metals and a readily fusible auxiliary metal under high pressure producing a spray of adhesive agent customary for binding hard metals under high stress, and so directing the sprays that the spray of metallic powder and the spray of adhesive liquid will meet on their way to the molds, or within the latter, whereby the mold will become filled with a compact moist mass of metallic powder and finally completing the hard metallic particle thus formed by sintering.

U.S. Pat. No. 4,707,332 teaches a process for manufacturing structural parts from intermetallic phases capable of sintering by means of special additives which serve at the same time as sintering assists and increase the ductility of the finished structural product.

Finally, U.S. Pat. No. 4,464,206 relates to a wrought powder metal process for pre-alloyed powder. In particular, U.S. Pat. No. 4,464,206 teaches a process comprising the steps of communinuting substantially non-compactible prealloyed metal powders so as to flatten the particles thereof heating the communinuted particles of metal powder at an elevated temperature, with the particles adhering and forming a mass during heating, crushing the mass of metal powder, compacting the crushed mass of metal powder, sintering the metal powder and hot working the metal powder into a wrought product.

The processes as described in the prior art above present a relatively less cost effective process to achieve the desired mechanical properties of the sintered product.

It is an object of this invention to provide an improved process for producing sintered articles having improved dynamic strength characteristics and an accurate method to control same.

It is an aspect of this invention to provide a process of forming a sintered article of powder metal comprising blending carbon, and ferro alloy powder and lubricant with compressible elemental iron powder, pressing the blended mixture to form the article, and then high temperature sintering the article in a reducing atmosphere or under a vacuum.

Another aspect of this invention resides in a process of forming a sintered article of powder metal comprising blending carbon and ferro alloy powder and lubricant with compressible elemental iron powder, pressing the blended mixture to form the article and then high temperature sintering the article in a neutral or reducing atmosphere with a dew point of not higher than minus 20° C. or under a vacuum to produce sintered parts which contain typically not more than 250 ppm oxygen. Moreover it is another aspect of this invention that articles are brought to a temperature not greater than 150° C. after sintering in a low dew point atmosphere of not higher than minus 30° C.

It is another aspect of this invention to provide a process of forming a sintered article of powder metal comprising; selecting elemental iron powder, determining the desired properties of said sintered article and selecting, a quantity of carbon, and a combination of ferro alloy powder from the group of ferro manganese, ferro chromium, ferro molybdenum, ferro vanadium, ferro silicon and ferro boron and selecting the quantity of same; grinding separately each said ferro alloy to a mean particle size of approximately 8 to 12 microns and substantially all of said ferro alloy having a particle size of less than 25 microns; introducing a lubricant while blending the carbon, and ferro alloy, with said elemental iron powder; pressing the mixture to form the article; and then high temperature sintering the article at a temperature between 1,250° C. and 1,350° C. in a neutral atmosphere or a reducing atmosphere such as 90% nitrogen and 10% hydrogen, so as to produce the sintered article of powdered metal.

It is another aspect of this invention to provide an as-sintered ferrous metal product comprising a compacted and sintered mass composed of a blend of elemental iron, carbon and ferro manganese alloy having a mean particle size of approximately 8 to 12 microns, subjected to a high temperature sinter so as to result in an as-sintered mass having between 0.3 to 2.5% manganese and between 0.2 to 0.85% carbon composition wherein said product is machined or coined to final dimensional requirements.

It is another aspect of this invention to provide a sinter-hardened ferrous metal product comprising a compacted and sintered mass composed of a blend of elemental iron, carbon, and ferro manganese alloy and ferro molybdenum alloy, said ferro manganese and ferro molybdenum alloy having a mean particle size of approximately 8 to 12 microns, subjected to a high temperature sinter so as to result in a sinter hardening mass having a up to 1.0 to 2.0% manganese, between 0 to 1.0% molybdenum, and between 0.5 to 0.85% carbon composition. It has been found that sinter-hardening produces an article which hardens to a hardness greater than HRB 90 in the furnace cooling zone.

It is another aspect of this invention to provide a gas quenched ferrous metal product comprising of a blend of elemental iron, carbon, ferro manganese, ferro chromium and ferro molybdenum having a mean particle size of approximately 8 to 12 microns, subjected to a high temperature sinter and then gas pressure quenching said product at a pressure of for example up to 5 bar so as to result in a hardened sintered mass having between 0.5 to 2.0% manganese, between 0.5 to 1.5% molybdenum between 0 to 1.0% chromium and between 0 to 0.6% carbon composition.

It is another aspect of this invention to provide a high strength ferrous metal product comprising compacted and sintered mass composed of a blend of elemental iron powder, carbon, ferro manganese alloy, ferro chromium and ferro molybdenum having a mean particle size of approximately 8 to 12 microns, subjected to a high temperature sinter which is hardened and tempered to impart high strength, having between 0.5% to 2.0% manganese, between 0.5 to 2.0% chromium, between 0 to 1.0% molybdenum and between 0.1% to 0.6% carbon.

It is another aspect of this invention to provide a high ductility ferrous metal product comprising a compacted and sintered mass composed of a blend of elemental iron powder, carbon, ferro chromium and ferro molybdenum alloy having a mean particle size of approximately 8 to 12 microns, subjected to a high temperature sinter in a neutral or reducing atmosphere so as to result in a mass having between 0.5 to 2.0% chromium, between 0 to 1.0% molybdenium and between 0.1 to 0.6% carbon composition.

It is another aspect of this invention to provide a high ductility ferrous metal product comprising a compacted and sintered mass composed of a blend of elemental iron, carbon, chromium and molybdenum, the ferro alloys having a mean particle size of approximately 8 to 12 microns and subjected to a high temperature sinter. This alloy may be used for further deformation to final dimensional requirements by extrusion, rolling and forging and may be subsequently heat treated for high strength.

DESCRIPTION OF DRAWINGS

These and other features and objections of the invention will now be described in relation to the following drawings.

DESCRIPTION OF THE INVENTION

Figure 1:
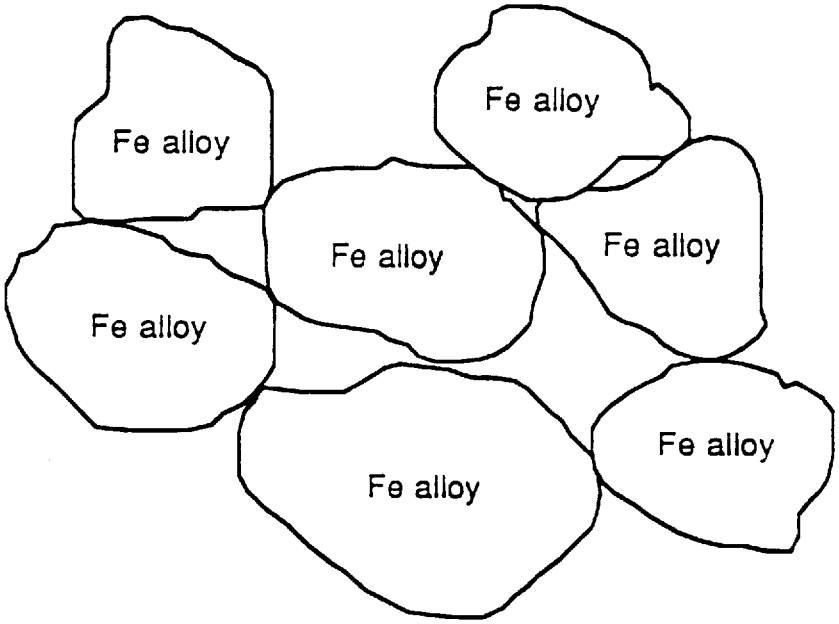
FIG. 1 is a drawing of the prior art mixture of iron alloy.

FIG. 1 is a representative view of a mixture of powder metal utilized in the prior art which consists of particles of ferro alloy in powder metal technology.

In particular, copper and nickel may be used as the alloying materials, particularly if the powder metal is subjected to conventional temperature of up to 1150° C. during the sintering process.

Moreover, other alloying materials such as manganese, chromium, and molybdenum which were alloyed with iron could be added by means of a master alloy although such elements were tied together in the prior art. For example a common master alloy consists of 22% of manganese, 22% of chromium and 22% of molybdenum, with the balance consisting of iron and carbon. The utilization of the elements in a tied form made it difficult to tailor the mechanical properties of the final sintered product for specific applications. Also the cost of the master alloy is very high and uneconomic.

By utilizing ferro alloys which consist of ferro manganese, or ferro chromium or ferro molybdenum or ferro vanadium, separately from one another rather than utilizing a ferro alloy which consists of a combination of iron, with manganese, chromium, molybdenum or vanadium tied together a more accurate control on the desired properties of the finished product may be accomplished so as to produce a method having more flexibility than accomplished by the prior art as well as being more cost effective.

Figure 2:
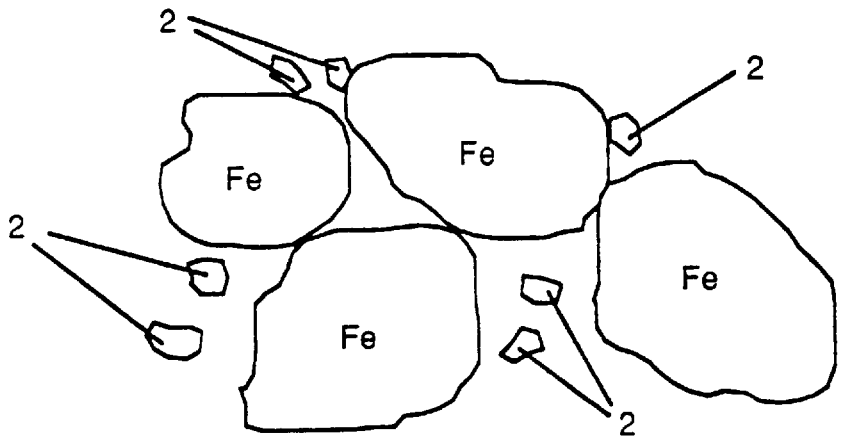
FIG. 2 is a drawing of a mixture of elemental iron, and ferro alloy in accordance with the invention described herein.

FIG. 2 is a representative drawing of the invention to be described herein, which consists of iron particles, Fe having a mixture of ferro alloys 2.

The ferro alloy 2 can be selected from the following groups:

| Name | Symbol | Approx. % of Element other than Iron |
|---|---|---|
| ferro manganese | FeMn | 78% |
| ferro chromium | FeCr | 65% |
| ferro molybdenum | FeMo | 71% |
| ferro vanadium | FeVa | 75% |
| ferro silicon | FeSi | 75% |
| ferro boron | FeB | 17.5% |

Chromium molybdenum and vanadium are added to increase the strength of the finished product particularly when the product is subjected to heat treatment after sintering. Moreover, manganese is added to increase the strength of the finished product, particularly if one is not heat treating the product after the sintering stage. The reason for this is manganese is a powerful ferrite strengthener (up to 4 times more effective than nickel).

Figure 3:
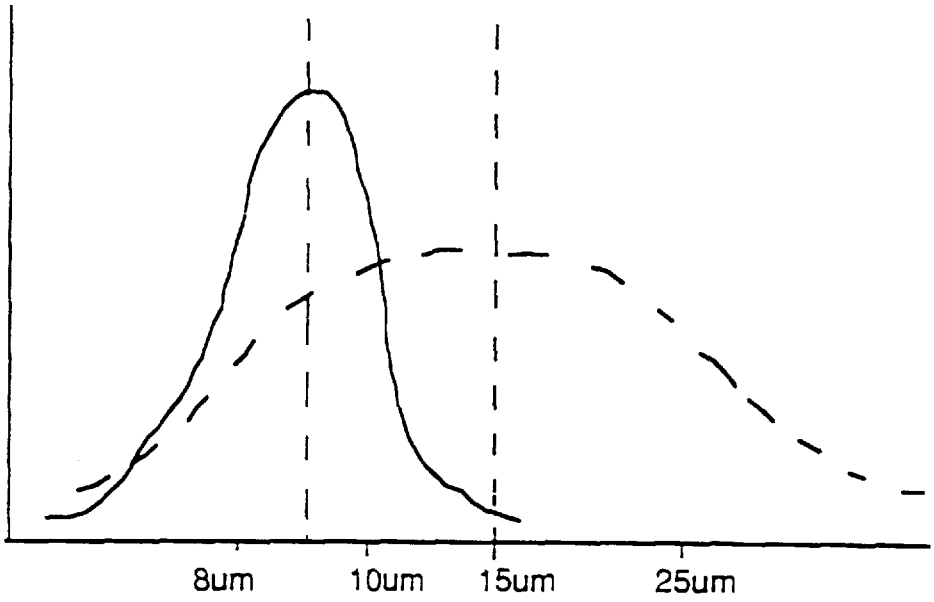
FIG. 3 is a graph showing the distribution of particle size in accordance with the invention herein.

Particularly good results are achieved in the method described herein by grinding the ferro alloys so as to have a $D_{50}$ or mean particle size of 8 to 12 microns and a $D_{100}$ of up to 25 microns where substantially all particles of the ferro alloys are less than 25 microns as shown in FIG. 3. For certain application a finer distribution may be desirable. For example a $D_{50}$ of 4 to 8 microns and a $D_{100}$ of 15 microns.

Many of the processes used in the prior art have previously used a $D_{50}$ of 15 microns as illustrated by the dotted lines of FIG. 3. It has been found that by finely grinding the ferro alloy to a fine particle size in an inert atmosphere as described herein a better balance of mechanical properties may be achieved having improved sintered pore morphology. In other words the porosity is smaller and more rounded and more evenly distributed throughout the mass which enhances strength characteristics of the finished product. In particular, powder metal products are produced which are much tougher than have been achieved heretofore.

The ferro alloy powders may be ground by a variety of means so long as the mean particle size is between 8 and 12 microns. For example, the ferro alloy powders may be ground in a ball mill, or an attritor, provided precautions are taken to prevent oxidation of the ground particles and to control the grinding to obtain the desired particle size distribution.

Figure 4:
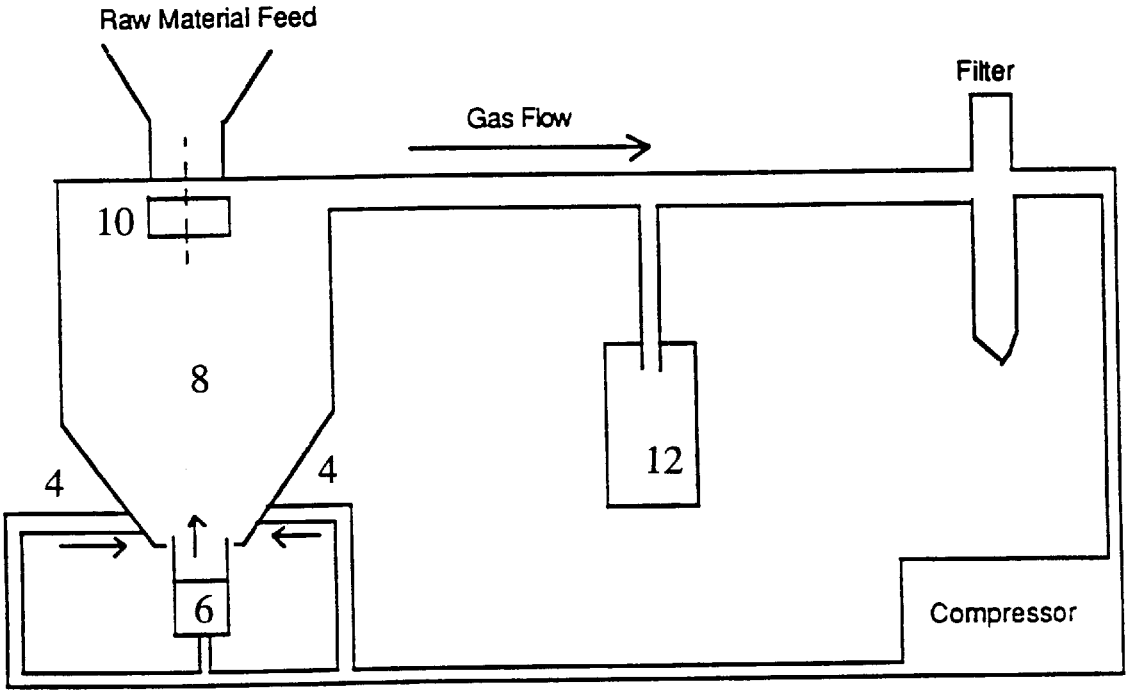
FIG. 4 is representative drawing of a jet mill utilized to produce the particle size of the ferro alloy.

Particularly good results in controlling the particle size as described herein are achieved by utilizing the jet mill illustrated in FIG. 1. In particular, an inert gas such as cyclohexane, nitrogen or argon is introduced into the grinding chamber via nozzles 4 which fluidize and impart high energy to the particles of ferro alloys 6 upward and causes the ferro alloy particles to break up against each other. As the ferro alloy particles grind up against each other and reduce in size they are lifted higher up the chamber by the gas flow and into a classifier wheel 10 which is set at a particular RPM. The particles of ferro alloy enter the classifier wheel 10 where the ferro alloy particles which are too big are returned into the chamber 8 for further grinding while particles which are small enough namely those particles of ferro alloy having a particle size of less than 25 microns pass through the wheel 10 and collect in the collecting zone 12. The grinding of the ferro alloy material is conducted in an inert gas atmosphere as described above in order to prevent oxidization of the ferro alloy material. Accordingly, the grinding mill shown in FIG. 4 is a totally enclosed system. The jet mill which is utilized accurately controls the size of the particles which are ground and produces a distribution of ground particles which are narrowly centralized as shown in FIG. 3. The classifier wheel speed is set to obtain a $D_{50}$ of 8 to 10 microns. The speed will vary with different ferro alloys being ground.

The mechanical properties of a produced powder metal product may be accurately controlled by:

(a) selecting elemental iron powder;

(b) determining the desired properties of the sintered article and selecting:

(i) a quantity of carbon; and (ii) the ferro alloy(s) from the group of ferro manganese, ferro chromium, ferro molybdenum, and ferro vanadium and selecting the quantity of same;

(c) grinding separately the ferro alloy(s) to a mean particle size of approximately 8 to 12 microns, which grinding may take place in a jet mill as described herein;

(d) introducing a lubricant while blending the carbon and ferro alloy(s) with the elemental iron powder;

(e) pressing the mixture to form the article; and (f) subjecting the article to a high temperature sintering at a temperature of between 1,250° C. and 1,350° C. in a reducing atmosphere of, for example 90% nitrogen and 10% hydrogen.

The lubricant is added in a manner well known to those persons skilled in the art so as to assist in the binding of the powder as well as assisting in the ejecting of the product after pressing. The article is formed by pressing the mixture into shape by utilizing the appropriate pressure of, for example, 25 to 50 tonnes per square inch.

The invention disclosed herein utilizes high temperature sintering of 1,250° C. to 1,350° C. and a reducing atmosphere of, for example nitrogen and hydrogen in a 90/10% ratio, or in vacuum. Moreover, the reducing atmosphere in combination with the high sintering temperature reduces or cleans off the surface oxides allowing the particles to form good bonds and the compacted article to develop the appropriate strength. A higher temperature is utilized in order to create the low dew point necessary to reduce the oxides of manganese and chromium which are difficult to reduce. The conventional practice of sintering at 1150° C. does not create a sintering regime with the right combination of low enough dew point and high enough temperature to reduce the oxides of chromium, manganese, vanadium and silicon.

Secondary operations such as machining or the like may be introduced after the sintering stage. Moreover, heat treating stages may be introduced after the sintering stage.

Advantages have been realized by utilizing the invention as described herein. For example, manganese, chromium and molybdenum ferro alloys are utilized to strengthen the iron which in combination or singly are less expensive than the copper and nickel alloys which have heretofore been used in the prior art. Moreover, manganese appears to be four times more effective in strengthening iron than nickel as 1% of manganese is approximately equivalent to 4% nickel, and accordingly a cost advantage has been realized.

Furthermore sintered steels with molybdenum, chromium, manganese and vanadium are dimensionally more stable during sintering at high temperatures described herein than are iron-copper-carbon steels (i.e. conventional powder metal (P/M) steels). Process control is therefore easier and more cost effective than with conventional P/M alloys.

Furthermore, the microstructure of the finished product are improved as they exhibit:

(a) well rounded pores;

(b) a homogenous structure;

(c) structure having a much smaller grain size; and (d) a product that is more similar to wrought and cast steels in composition than conventional powder metal steels.

The process described herein allows one to control or tailor the materials which are desired for a particular application.

(1) sinter hardening grades (2) gas quenched grades (3) as sintered grades (4) high strength grades (5) high ductility grades The following chart provides examples of the four grades referred to above as well as the range of compositions that may be utilized in accordance with the procedure outlined herein.

| Alloy Type | Composition | | Typical Mechanical Properties | |
|---|---|---|---|---|
| | | | Ultimate Tensile Strength UTS (ksi) | Impact ft/lb. |
| As Sintered | Mn: | 0.3–2.5% | 90 | 25 |
| | C: | 0.2–0.85% | | |
| Sinter Hardening | Mn: | 1.0–2.0% | 120 | 15 |
| | C: | 0.5–0.85% | | |
| | Mo: | 0–1.0% | | |
| Gas Quenched | Mn: | 0.5–2.0% | 150 | 15 |
| | Mo: | 0.5–1.5% | | |
| | C: | 0–0.6% | | |
| | Cr: | 0–1.0% | | |
| High Strength | Mn: | 0.5–2.0% | 200 | 8 |
| | Cr: | 0.5–2.0% | | |
| | Mo: | 0–1.0% | | |
| | C: | 0.1–0.6% | | |
| High Ductility | Cr: | 0.5–2.0% | 80 | 15 |
| | Mo: | 0–1.0% | | |
| | C: | 0.1–0.6% | | |

Particularly good results were achieved with the as sintered grade with 1.5% Mn and 0.8% C; UTS of 90 ksi and impact strength of 20 ft lbs. Other combinations of alloying are possible to produce articles with specifically tailored balance of properties such as high toughness and wear resistance.

Moreover good results were achieved with:

(a) sinter hardening grade with 1.5% Mn, 0.5% Mo, and 0.85% C;

(b) gas quenching grade (i) with 1.5% Mn, 0.5% Mo, and 0.5% C (ii) with 0.5% Cr, 1.0% Mn, and 0.5% C (c) high strength grade (i) with 1.0% Mn, 0.5% C, 0.5% Cr, 0.5% Mo (ii) with 1.5% Cr, 0.6% C, 1.0% Mn, Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. An as-sintered ferrous metal product comprising a compacted and sintered mass composed of a blend of iron powder, carbon and ferro manganese alloy having a mean particle size of approximately 8 to 12 microns, subjected to a high temperature sinter so as to result in an as-sintered mass having between 0.3 to 2.5% manganese and between 0.2 to 0.85% carbon composition where said product is machined or coined to final dimensional requirements.

2. An as-sintered ferrous metal product comprising a compacted and sintered mass composed of a blend of iron powder, carbon and ferro manganese alloy having a mean particle size of approximately 8 to 12 microns, subjected to high temperature sinter so as to result in an as-sintered mass having 0.5% to 2.5% manganese and between 0.2 to 0.85% carbon composition where said product is machined or coined to final dimensional requirements.

3. An as-sintered ferrous metal product comprising a compacted and sintered mass composed of a blend of iron powder, carbon and ferro manganese alloy having a mean particle size of approximately 8 to 12 microns, subjected to high temperature sinter so as to result in an as sintered mass having 1.5% manganese and 0.8% carbon composition where said product is machined or coined to final dimensional requirements.

4. A gas quenched ferrous metal product comprising of a blend of iron powder, carbon, ferro manganese alloy, ferro chromium and ferro molybdenum alloy having a mean particle size of approximately 8 to 12 microns, subjected to a high temperature sinter and then gas pressure quenching said product so as to result in a hardened sintered mass having between 0.5 to 2.0% manganese, between 0.5 to 1.5% molybdenum between 0 to 1.0% chromium and between 0 to 0.6% carbon composition.

5. A sinter hardened ferrous metal product comprising a compacted and sintered mass composed of a blend of iron powder, carbon, and ferro manganese alloy and ferro molybdenum alloy, said ferro manganese alloy and ferro molybdenum alloy having a mean particle size of approximately 8 to 12 microns, subjected to a high temperature sinter so as to result in a sinter hardened mass having between 1.0 to 2.0% manganese, between 0 to 1.0% molybdenum, and between 0.5 to 0.85% carbon composition.

6. A high strength ferrous metal product comprising compacted and sintered mass composed of a blend of iron powder, carbon, ferro manganese, ferro chromium, ferro molybdenum alloy having a mean particle size of approximately 8 to 12 microns, subjected to a high temperature sinter which is induction hardened and air cooled to impart high strength, said product having between 0.5 to 2.0% manganese, between 0.5 to 2.0% chromium, between 0 to 1.0% molybdenum and between 0.1 to 0.6% carbon.

7. A high ductility ferro metal product comprising a compacted and sintered mass composed of a blend of iron powder, carbon, ferro molybdenum and ferro chromium alloy having a mean particle size of approximately 8 to 12 microns, subjected to a high temperatured sinter which is induction hardened and air cooled to impart impact strength so as to result in a mass having between 0.5 to 2.0% chromium, between 0 to 1.0% molybdenum and between 0.1 to 0.6% carbon composition.

8. In a high strength ferrous metal product comprising compacted and sintered mass composed of a blend of elemental iron powder, carbon, ferro manganese, ferro chromium, ferro molybdenum alloy having a mean particle size of approximately 8 to 12 microns, subjected to a high temperature sinter which is hardened and tempered to impart high strength, said product having between 0.5 to 2.0% manganese, between 0.5 to 2.0% chromium, between 0 to 1.0% molybdenum and between 0.1 to 0.6% carbon.

9. In a high ductility ferro metal product comprising a compacted and sintered mass composed of a blend of elemental iron powder, carbon, ferro molybdenum and ferro chromium alloy having a mean particle size of approximately 8 to 12 microns, subjected to a high temperature sinter so as to result in a mass having between 0.5 to 2.0% chromium, between 0 to 1.0% molybdenum and between 0.1 to 0.6% carbon composition.

10. A ferrous metal article comprising:

a sintered mass of iron powder and carbon blended with at least one ferro alloy powder selected from ferro manganese, ferro molybdenum, ferro chromium, ferro vanadium and ferro silicon;

those ferro alloy particles having a mean particle size of between 8 and 12 microns; and a lubricant.

11. The article of claim 10 wherein said at least one ferro alloy comprises, first, ferro manganese, and second, a ferro alloy selected from the set of ferro molybdenum and ferro chromium.

12. The article of claim 10 wherein said article comprises, by weight percent:

0.3 to 2.5% manganese and 0.2% to 0.85% carbon the balance being iron.

13. The article of claim 12 comprising by weight 0.8% carbon and 1.5% manganese.

14. The article of claim 10 wherein said article comprises, by weight percent, 1.0 to 2.0% manganese; 0.5 to 0.85% carbon; and up to 1.0% molybdenum, the balance being iron.

15. The article of claim 10 wherein said article comprises, by weight percent, 0.5 to 2.0% manganese; 0.5 to 1.5% molybdenum; up to 0.6% carbon; and up to 1.0% chromium, the balance being iron.

16. The article of claim 10 wherein said article comprises, by weight, percent, 0.5 to 2.0% manganese; 0.5 to 2.0% chromium, up to 1.0% molybdenum; 0.1 to 0.6% carbon, and the balance being iron.

17. The article of claim 10 wherein said article comprises, by weight percent, 0.5 to 2.0% chromium; up to 1.0% molybdenum; 0.1 to 0.6% carbon, the balance being iron.

18. The article according to claim 10 wherein the sintered mass has been subjected to gas pressure quenching.

19. The article of claim 10 having been machined or coined to final dimensional requirements.

20. An iron powder composition comprising a blended mixture of:

(a) carbon (b) at least one ferro alloy powder selected from the group of separate ferro alloy particles of the ferro manganese, ferro chromium, ferro molybdenum, ferro vanadium and ferro silicon; those ferro alloy particles having a mean particle size of approximately 8 to 12 microns (c) lubricant, and (d) compressible iron powder.

21. An iron powder composition as claimed in claim 20 wherein said composition contains lubricant and 0.3 to 2.5% manganese 0.2 to 0.85% carbon and the balance iron.

22. An iron powder composition as claimed in claim 20 wherein said composition contains lubricant and 1.0 to 2.0% manganese 0.5 to 0.85% carbon up to 1.0% molybdenum and the balance iron.

23. An iron powder composition as claimed in claim 20 wherein said composition contains lubricant and 0.5 to 2.0% manganese 0.5 to 1.5% molybdenum up to 1.0% chromium and the balance iron.

24. An iron powder composition as claimed in claim 20 wherein said composition contains lubricant and 0.5 to 2.0% manganese 0.5 to 2.0% molybdenum up to 1.0% chromium 0.1 to 0.6% carbon and the balance iron.

25. An iron powder composition as claimed in claim 20 wherein said composition contains lubricant and 0.5 to 2.0% manganese 0 to 1.0% molybdenum 0.1 to 0.6% carbon and the balance iron.

26. An iron powder metal composition as claimed in claim 20 wherein said ferro alloy particles have a $D_{50}$ of 8 to 12 microns and a $D_{100}$ of up to 25 microns.

27. An iron powder composition as claimed in claim 26 wherein said ferro alloy is ground in an inert gas atmosphere.

28. An iron powder composition as claimed in claim 20 wherein said approximate percentage of elements other than iron in said ferro alloy is:

| | |
|---|---|
| FeMn | 78% |
| FeCr | 65% |
| FeMo | 71% |
| FeVa | 75% |
| FeSi | 75% |

* * * * *